US006170400B1

(12) United States Patent
Salort

(10) Patent No.: US 6,170,400 B1
(45) Date of Patent: Jan. 9, 2001

(54) DEVICE FOR THE CUTTING OF NONMETALLIC PARTS BY MEANS OF A PYROTECHNIC EXPANSION TUBE

(75) Inventor: Cédric Salort, Ville d'Avaray (FR)

(73) Assignee: AEROSPATIALE SociétéNationale Industrielle, Paris (FR)

( * ) Notice: Under 35 U.S.C. 154(b), the term of this patent shall be extended for 0 days.

(21) Appl. No.: 09/323,829

(22) Filed: Jun. 2, 1999

(30) Foreign Application Priority Data

Jun. 2, 1998 (FR) ..... 98 06898

(51) Int. Cl.[7] ..... F42B 15/10; F42B 3/00

(52) U.S. Cl. ..... 102/378; 89/1.15; 102/312; 102/313

(58) Field of Search ..... 102/312, 313, 102/378; 89/1.15

(56) References Cited

U.S. PATENT DOCUMENTS

| | | | | |
|---|---|---|---|---|
| 3,453,960 | | 7/1969 | Qualls | 102/49.5 |
| 3,486,410 | | 12/1969 | Drexelius et al. | 89/1 |
| 3,698,281 | | 10/1972 | Brandt et al. | 89/1 B |
| 4,314,500 | | 2/1982 | Hoppe | 89/1 B |
| 4,685,376 | | 8/1987 | Noel et al. | 89/1.14 |
| 4,778,009 | * | 10/1988 | Sumner et al. | 89/1.15 |
| 4,829,901 | * | 5/1989 | Yates, Jr. | 89/1.15 |
| 4,885,993 | * | 12/1989 | Hancock et al. | 102/312 X |
| 4,901,802 | * | 2/1990 | George et al. | 102/312 X |
| 5,331,894 | * | 7/1994 | Wassell et al. | 102/378 X |
| 5,390,606 | * | 2/1995 | Harris | 102/378 X |
| 5,392,684 | * | 2/1995 | Renfro et al. | 102/378 X |

FOREIGN PATENT DOCUMENTS

| | | |
|---|---|---|
| 0 246 958 | 11/1987 | (EP) . |
| 0 273 061 | 7/1988 | (EP) . |
| 2 598 769 | 8/1988 | (FR) . |

* cited by examiner

*Primary Examiner*—Peter A. Nelson
(74) *Attorney, Agent, or Firm*—Oblon, Spivak, McClelland, Maier & Neustadt, P.C.

(57) ABSTRACT

A pyrotechnic cutting device (14) is designed for directly cutting one or two parts (10) made from a nonmetallic material, such as a composite material. The device (14) comprises a pyrotechnic expansion tube, which acts directly on the part or parts (10) to be cut, as well as an abutment (40) placed on the other side of the part and facing the spacer (20) installed alongside the tube. The abutment acts in the manner of an anvil during the use or operation of the pyrotechnic expansion tube (16). Thus, there is a clearly defined, well localized cutting of the part (10) along the edge (42) of the abutment aligned with the face (21) of the spacer (20) turned towards the tube (16).

11 Claims, 3 Drawing Sheets

DEVICE FOR THE CUTTING OF NONMETALLIC PARTS BY MEANS OF A PYROTECHNIC EXPANSION TUBE

TECHNICAL FIELD

The invention relates to a cutting device using a pyrotechnic expansion tube for cutting at least one part, along a given cutting line.

Such a device can more particularly be used in the aeronautical and space industries for controlling in a very short time the separation of two structural elements, whilst ensuring the transmission of at times high forces and stresses between said two elements, before the cutting takes place.

PRIOR ART

When two metallic structures, between which forces, stresses or loads pass, have to be irreversibly separated in a very short time and in remotely controlled manner, use is currently made of pyrotechnic cutting devices integrated into the junction zone between the two structures.

When a clean cutting is desired, i.e. with a minimum release of dust, use is generally made of a cutting device including a pyrotechnic expansion tube.

The expression "pyrotechnic expansion tube" designates a tight, deformable, metallic tube in which runs a detonating cord or fuse. A flexible material such as silicone rubber is interposed between the detonating fuse and the envelope. Prior to firing, the envelope has an oblong cross-section, e.g. in the form of an ellipse or flattened circle.

When the detonating fuse is fired, the shock wave propagating at very high velocity along the tube deforms the envelope and tends to give it a substantially circular cross-section.

Conventionally a pyrotechnic cutting device including a pyrotechnic expansion tube is used for cutting metallic parts. It is therefore installed in a space formed between two metallic parts or between two portions of the same metallic part. The part or parts to be cut are previously machined, so as to have a reduced thickness zone along each desired cutting line. The expansion of the envelope caused by the firing of the detonating fuse leads to the cutting of the part or parts along the cutting line corresponding to the machined zone.

Devices for cutting one or two metallic parts by means of a pyrotechnic expansion tube are described in the following documents: U.S. Pat. Nos. 3,486,410, 3,453,960, 3,698,281, FR-A-2 598 796 and EP-A-0 273 061.

The structural elements used in the aeronautical and space industries are increasingly frequently made from nonmetallic materials. In particular, the materials used are often composite materials, i.e. materials formed from long fibres arranged in the form of superimposed sheets in preferred orientations and embedded in a resin matrix.

When such nonmetallic materials are used, it is not at present possible to directly cut them by means of a pyrotechnic expansion tube, as is normally the case with metallic structures.

Firstly, the machining of a reduced thickness zone in a nonmetallic material and in particular a composite material is at present indispensable for localizing and limiting the cutting produced by the pyrotechnic expansion tube, is unacceptable in a nonmetallic material, particularly of the composite type Thus, such a machining would unacceptably reduce the mechanical characteristics of the part prior to its cutting, by cutting the long fibres leading to its characteristics.

Moreover, the cutting of a nonmetallic and in particular composite material using a cutting device would possibly give rise to significant pollution of the environment, as well as to a marked reduction in the mechanical characteristics of the adjoining structures. This reduction would be due to so-called delamination phenomena, i.e. a detachment or separation of the fibre sheets in the vicinity of the cutting line.

For various reasons, when a pyrotechnic cutting device has at present to be integrated into a nonmetallic structure, between the two structural elements to be separated is interposed a metallic structure, whose cutting with the aid of a pyrotechnic expansion tube is controlled. In other words, separation is ensured by cutting one or more metallic parts joined to the nonmetallic material structural assemblies which it is wished to separate. This conventional arrangement makes the structure more complicated and increases costs.

It is also contrary to one of the essential advantages brought about by nonmetallic materials, namely the weight gain. Thus, the addition of metallic parts to the linking zone between the two structural assemblies to be separated leads to a non-negligible weight increase. This weight increase is particularly due to the metallic nature of the added parts and the indispensable presence of fixing members ensuring the connection between the metallic parts and the nonmetallic parts. This is a particularly prejudicial disadvantage in certain applications, such as the space industry.

The pyrotechnic cutting of metallic parts also produces relatively severe shocks. Such a shock is applied to often very sensitive instruments and equipment located in the vicinity thereof. However, the very different mechanical characteristics of nonmetallic materials would permit, if their direct cutting was possible, the separation by producing a much lower shock level. This would be an advantage for the embarked instruments and equipment.

DESCRIPTION OF THE INVENTION

The invention relates to a pyrotechnic cutting device making it possible to directly cut nonmetallic parts and in particular composite material parts by means of a pyrotechnic expansion tube, whilst maintaining the mechanical properties of such parts before and after their cutting and whilst limiting the pollution produced during cutting.

According to the invention, this result is obtained by means of a pyrotechnic cutting device comprising a pyrotechnic expansion tube installed in a space formed between two parts and defined by at least one spacer linking said two parts, so as to cut at least one of the parts along at least one cutting line when the tube is used, characterized in that each part to be cut is of a nonmetallic material, an abutment being fixed thereto, opposite to and facing the spacer, so that one edge of the abutment extends along the cutting line.

The abutment fixed to the outside of the part to be cut, facing the spacer, acts in the manner of an anvil against which bears the corresponding portion of the part during the firing of the detonating fuse. This ensures a relatively clean and well localized cutting, without machining the parts. Therefore the mechanical strength of the parts prior to cutting is not cast into doubt. Moreover, the cleanness of the cut preserves the integrity of the parts after cutting and greatly limits pollution.

By rendering possible the direct cutting of nonmetallic materials and in particular composite materials, the device according to the invention makes it possible to very significantly reduce the weight of the nonmetallic assemblies to be cut with the aid of a pyrotechnic expansion tube. Moreover, the device according to the invention makes it possible to significantly reduce the shock level producing during cutting compared with that produced during the cutting of metallic parts.

In a first embodiment of the invention, each abutment is substantially non-deformable.

Conversely, in a second embodiment of the invention, each abutment is made from a deformable material.

In order to even better preserve the integrity of the cut part and in particular oppose its delamination in the case of a composite material part, a maintaining member made from a deformable material is preferably fixed to each part to be cut, opposite to and facing the pyrotechnic expansion tube. The maintaining member then comprises an edge extending along the cutting line and prolonged on moving away from said edge.

When the device comprises both an abutment and a maintaining member, said two members can be made from the same material as the part to be cut and said material is advantageously a composite material formed from sheets of long fibres embedded in a resin matrix. The assembly is then produced directly by covering during the manufacture of the part.

Moreover, the parts and the spacer can be made from the same nonmetallic material in monolithic form. In other words, the pyrotechnic expansion tube is then integrated into the assembly during the manufacture of the parts.

Conversely, the spacer can be fixed between the parts by fixing means such as bolts traversing the same.

All the variants and shapes according to the invention are applicable both when one of the two parts is to be cut and when both parts are to be cut.

In the first case, the other part is a substantially non-deformable support part, connected to the part to be cut by one or two spacers.

In the second case, the space in which is housed the pyrotechnic expansion tube is defined by two spacers and an abutment is placed on each of the parts to be cut, facing a first of the spacers.

In a particularly advantageous embodiment of the invention, the two parts then form the skins of a first sandwich structure including a core, and the two abutments form the skins of a second sandwich structure also including a core. Terminal portions of the parts forming the skins of the first sandwich structure then penetrate the second sandwich structure, between the abutments and the second spacer.

In this case, the second spacer is fixed between the parts at a single location, which is preferably remote from the pyrotechnic expansion tube.

BRIEF DESCRIPTION OF THE DRAWINGS

A description will now be given in non-limitative manner of embodiments with reference to the attached drawings, wherein show.

DETAILED DESCRIPTION OF SEVERAL PREFERRED EMBODIMENTS OF THE INVENTION

Figure 1:
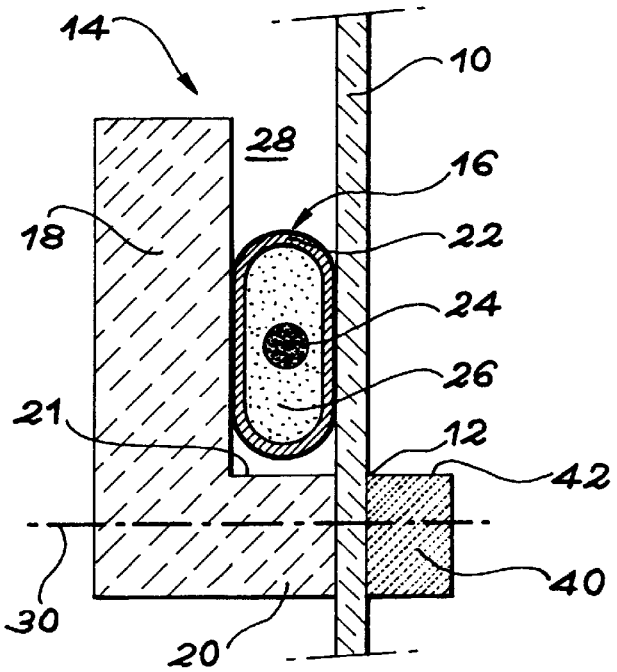
FIG. 1 A sectional view diagrammatically showing a first embodiment of the pyrotechnic cutting device according to the invention, according to which the abutment is substantially non-deformable, in the case where a single nonmetallic part is to be cut.

In FIG. 1, reference numeral 10 designates a nonmetallic material part which it is wished to cut along a cutting line 12. The nonmetallic material from which is formed the part 10 can be of different natures without passing outside the scope of the invention. A preferred application relates to the case where said material is a composite material, formed from sheets of long fibres embedded in a resin matrix. As is well known to the expert, such parts can be obtained by covering sheets of fibres impregnated with thermosetting resin, followed by the polymerization of the resin.

The part 10 to be cut can have various shapes without passing beyond the scope of the invention. In the case illustrated in FIG. 1, the part 10 is in the form of a plate with a substantially uniform thickness. Said plate can be planar, inwardly curved, or have any other shape adapted to the envisaged application.

The observations made hereinbefore in connection with part 10 also apply to the cutting line 12. In other words, the cutting of the part 10 can take place along a straight, curved or other line without passing beyond the scope of the invention.

In FIG. 1, the cutting device according to the invention is generally designated by reference numeral 14. In this case, the cutting device comprises a pyrotechnic expansion tube 16, a support part 18 and a spacer 20 (said two latter parts possibly being separate or in one piece, in the manner shown).

The pyrotechnic expansion tube 16 is implemented in the same way as in devices used for cutting metallic parts. However, it has reduced dimensions adapted to the nature of the material constituting the part 10 to be cut, so as to produce a much lower shock wave than in the cutting devices for metallic parts. Thus, there is no need for a detailed description of the pyrotechnic expansion tube 16.

To facilitate understanding, it is merely pointed out that the pyrotechnic expansion tube 16 comprises a tight, deformable, metallic envelope 22, a detonating cord or fuse 24 housed in the envelope 22, as well as a flexible material 26 interposed between the detonating fuse 24 and the envelope 22. The function of the flexible material 26 is to center the detonating fuse within the envelope. In exemplified manner, it can be made from silicone rubber. Prior to firing the envelope 22 has an oblong section, e.g. in the form of a flattened circle or oval, as illustrated in FIG. 1.

The pyrotechnic expansion tube 16 is received in a space 28 formed between the part 10 to be cut and the support part 18, said space 28 being defined on one side by a face 21 of the spacer 20. More specifically, the longest section of the envelope 22 is oriented parallel to the direction defined by the part 10 to be cut.

In the embodiment illustrated in FIG. 1, the support part 18 and spacer 20 form a single part, separate from the part 10 to be cut. This single part is fixed to the part to be cut by fixing means such as not shown bolts, whose location is diagrammatically illustrated by the mixed line 30.

The nature and thickness of the materials constituting the support part 18 and spacer 20 are such that these two parts are substantially non-deformable during the operation of the pyrotechnic expansion tube 16. This result is obtained either by using non-deformable materials of limited thickness, such as metals, or by using relatively flexible, but more thick materials, such as nonmetallic materials, as is illustrated in FIG. 1. In the latter case, as a variant the support part 18 and spacer 20 can be produced in one piece with the part 10 to be cut. There is then no longer any need for the fixing means such as bolts 30.

In all cases, the face of the support part 18 turned towards the part 10 to be cut constitutes a substantially non-deformable surface, which is generally parallel to the part 10 and on which bears the pyrotechnic expansion tube 16 during the firing of the detonating fuse 24. Consequently the expansion of the envelope 22 entirely takes place in the direction of the part 10 to be cut. In addition, the face 21 of spacer 20 turned towards the space 28 is aligned with the cutting line 12 of part 10.

It should be noted that the thickness of the pyrotechnic expansion tube 16 is substantially equal, apart from the installation clearance, to the width of the space 28, between the part 10 to be cut and the support part 18. A not shown element can be joined to the support part 18, or formed directly on said part in order to close the space 28 facing the spacer 20, if this should be necessary for preventing the release of tube 16.

According to the invention, an abutment 40 is fixed to the part 10 to be cut, facing the spacer 20 and opposite to the latter. The abutment 40 is in the form of a plate, whereof one edge 42 extends along the cutting line 12 of part 10.

In the embodiment illustrated in FIG. 1, the abutment 40 is substantially non-deformable. The non-deformable character of the abutment can be obtained either by using a relatively thick, nonmetallic material, as shown, or by using a reduced thickness, metallic material.

The not shown fixing means, whose location is indicated by the mixed line 30, effectively maintain the abutment 40 against part 10, in the vicinity of the cutting line 12.

The presence of the abutment 40 ensures a precise, localized cutting, by acting in the manner of an anvil on which bears the part 10 to be cut.

When the detonating fuse 24 is fired, the resulting shock wave brings about the expansion of the envelope 22, which tends to assume a substantially circular cross-section. In view of the fact that the pyrotechnic expansion tube 16 bears on a substantially non-deformable part 18, its expansion essentially takes place in the direction of the part 10 to be cut. It is therefore totally applied to the part 10. In view of the fact that the latter bears on the abutment 40 in its portion facing spacer 20, the expansion of the tube 16 consequently precisely cuts the part 10 along the previously defined cutting line 12.

Thus, there is a precise, perfectly localized cut of the part 10 made from the nonmetallic material. In addition, said cut is relatively clean.

It should be noted that cutting essentially takes place by shearing, which limits pollution. Moreover, such cutting by shearing requires a relatively low pyrotechnic energy level in the case of a nonmetallic material and in particular a composite material.

Figure 2:
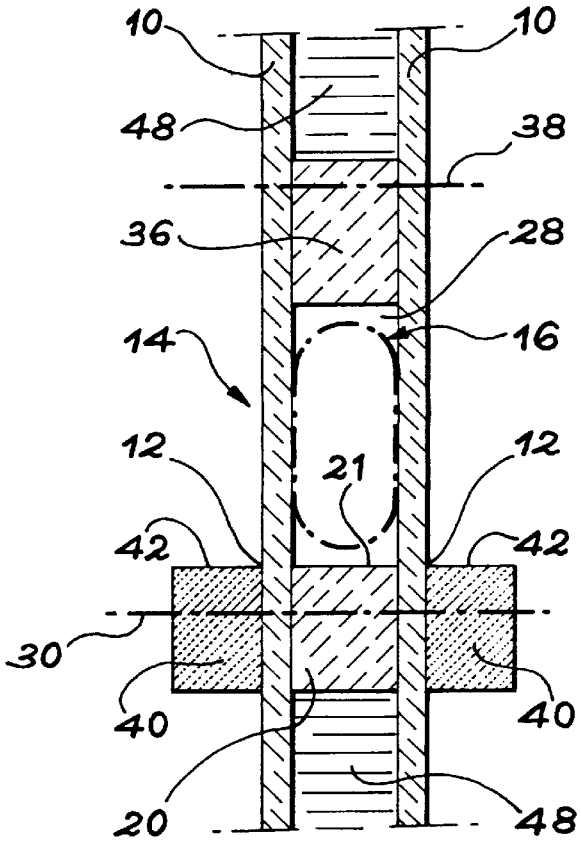
FIG. 2 A diagrammatic sectional view showing a variant of the cutting device of FIG. 1, applied to the simultaneous cutting of two nonmetallic parts.

FIG. 2 shows a variant of the first embodiment of the invention described hereinbefore relative to FIG. 1. This variant relates to the case where the pyrotechnic cutting device 14 is used for simultaneously cutting two parts 10, which are substantially parallel to one another and which define between them a space 28. In this case, the space 28 is closed opposite to the spacer 20, e.g. by a second spacer 36. The spacer 36 is fixed to the parts 10 by fixing means such as not shown bolts, whose location is diagrammatically illustrated by the mixed line 38 in FIG. 2.

As a variant, the spacer 36 can be in one piece with the two parts 10 or replaced by the direct junction of said two parts, which are then joined together.

In the constructional variant of FIG. 2, an abutment 40 is fixed to the outer face of each of the two parts 10, facing the spacer 20. More specifically, an edge 42 of each of the abutments 40 is aligned with the cutting line 12 provided in each of the parts 10 and consequently with the face 21 of spacer 20 turned towards the space 28.

It should be noted that the localization of the cutting along the cutting lines 12 is made easier if the portions of the parts 10 in contact with the pyrotechnic expansion tube 16 are able to easily bend towards the outside whilst pivoting about their anchoring point, diagrammatically illustrated by the mixed lines 38 in FIG. 2. To this end, the fixing of the parts 10 to the spacer 36 must take place as far away as possible from the tube 16 and the cutting lines 12 provided in the parts. Conversely, as in the embodiment of FIG. 1, it is desirable for the fixing of the abutments 40 and parts 10 to the spacer 20, illustrated by the mixed lines 30, to be as close as possible to the cutting lines 12.

In the case of the variant of FIG. 2, the abutments 40 are substantially non-deformable, as in the embodiment previously described relative to FIG. 1.

Figure 3:
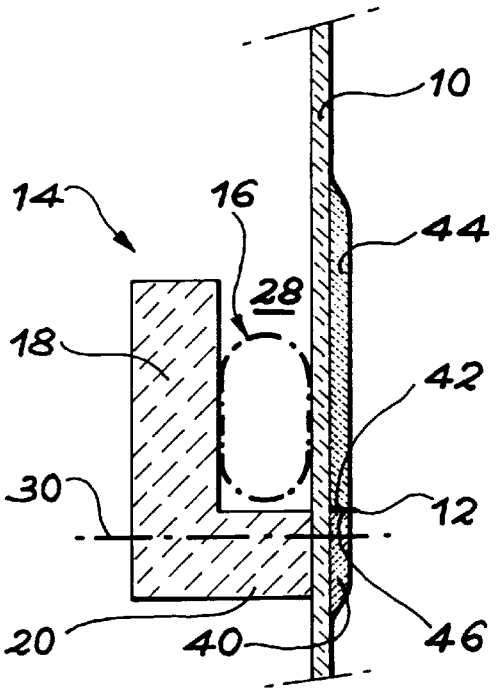
FIG. 3 A diagrammatic sectional view comparable to FIG. 1, illustrating a second embodiment of the invention, according to which the abutment is deformable, in the case where the device also has a maintaining member.

FIG. 3 diagrammatically shows a second embodiment of a pyrotechnic cutting device 14 according to the invention. As in the case of FIG. 1, FIG. 3 illustrates the simplest case where the cutting only applies to a single part 10. The general arrangement is consequently comparable to that described hereinbefore relative to FIG. 1, so that there is no need for a detailed description of the various parts in this case constituting the cutting device 14.

A first difference is due to the fact that instead of being substantially non-deformable, the abutment 40 is deformable and is made from a material preferably identical or very close to the nonmetallic material from which the part 10 to be cut is made.

Thus, when the part 10 is made from a composite material constituted by sheets of long fibres embedded in a resin matrix, the abutment 40 can be obtained by covering supplementary layers of thermosetting resin-impregnated fibres. The abutment is then linked to the part 10 over the entire surface adjacent thereto during the manufacture of the part.

In this case the orientation of the fibres in the abutment 40 can significantly differ from that of the fibres in part 10, in order to take account of the specific function of abutment 40. Thus, the fibres in the abutment 40 are advantageously interlaced in order to ensure the taking up again of the radial forces and stresses applied thereto during the operation of the pyrotechnic expansion tube 10. Conversely, the fibres placed in part 10 are generally largely oriented in the longitudinal direction, so as to ensure the transmission of the stresses and forces applied thereto mainly in said direction.

FIG. 3 shows an improvement to the cutting device according to the invention. It should be noted that this improvement can also be used in the previously described embodiment and variant.

According to this improvement, a maintenance or maintaining member 40 is also fixed to the part 10, opposite to the pyrotechnic expansion tube 16 and facing the latter. The maintaining member 40 comprises an edge 46 extending along the cutting line 12. Said edge 46 is substantially in contact with the edge 42 of abutment 40.

The maintaining member 44 is made from a deformable material in order to follow the deformation of part 10 during its cutting controlled by the use of the pyrotechnic expansion tube 16 and it extends over a certain distance opposite to its edge 46.

The maintaining member 44 is advantageously made from a material identical to that from which is formed the part 10 to be cut. In the At case where the latter is a composite material, the maintaining member 44 can consequently be directed integrated into the part during its manufacture, in the same way as the abutment 40 in the embodiment of FIG. 3.

The functions of the maintaining member 44 are to maintain the integrity of the corresponding portion of part 10 and absorb the shock during cutting. It consequently further improves the cleanness of the cut. More particularly in the case of a composite material, the maintaining member maintains the integrity of the adjacent portion of part 10 following cutting and opposes the delamination thereof.

Figure 4:
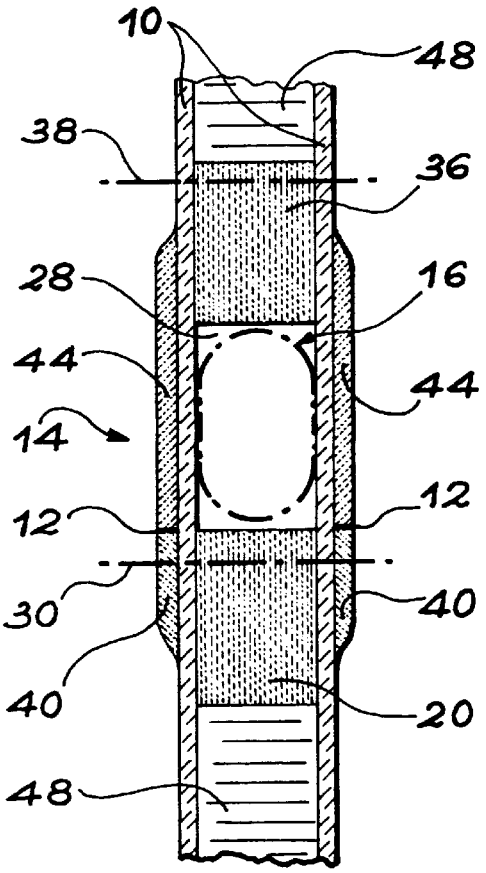
FIG. 4 A diagrammatic sectional view showing a variant of the cutting device of FIG. 3, applied to the simultaneous cutting of two nonmetallic parts.

FIG. 4 shows a pyrotechnic cutting device comparable to that described hereinbefore relative to FIG. 3 and applied to the simultaneous cutting of two parts 10.

In this case, the maintaining members 44 associated with the parts 10 to be cut are fixed to a spacer 36 by fixing means such as the not shown bolts, whose location is illustrated by the mixed lines 38 and whilst respecting the same conditions as those described relative to FIG. 2. More specifically, the fixing of parts 10 and maintaining members 44 to the spacer 36 takes place at a location 38 relatively remote from the tube 16 and cutting lines 12 adjacent to the spacer 20 and the abutments 40. This facilitates the bending of the parts 10 by pivoting about the aforementioned fixing means, which is necessary for a good cutting by shearing of the two parts along the spacer 20 and abutments 40.

When the cutting device 14 according to the invention ensures the simultaneous cutting of two parts 10, as is the case in the variants of FIGS. 2 and 4, the parts 10 can assume very varied shapes, outside the junction zone containing the cutting device.

Thus, as shown in FIGS. 2 and 4, the two parts 10 can remain parallel to one another and can be linked by a cellular structure 48, e.g. a honeycomb structure. The parts 10 then constitute the skins of a sandwich structure, whose core is formed by the cellular structure 48.

As a variant, the parts 10 can also be interconnected so as to form a one-piece structure, outside the junction zone materialized by the device 14. In this case, the spacers 20 and 36 can optionally form integral portions of said parts 10.

Figure 5:
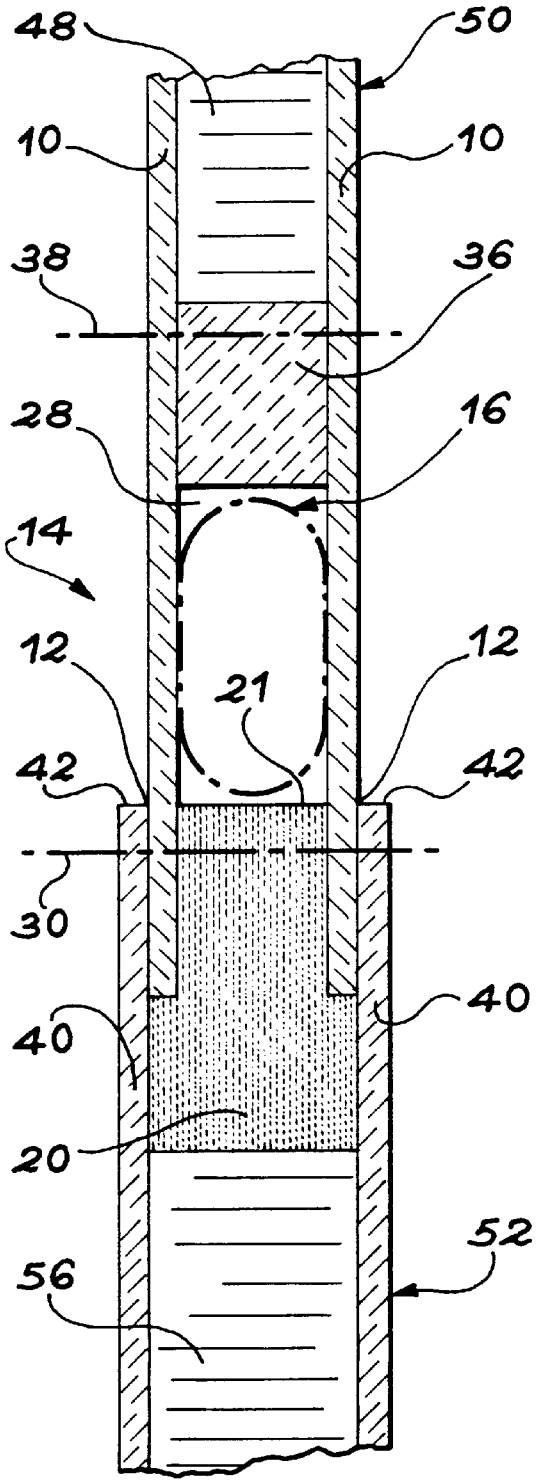
FIG. 5 A diagrammatic sectional view illustrating another embodiment of the invention, in which two parts to be cut and two abutments respectively form the skins of two sandwich structures which it is wished to separate.

FIG. 5 shows another, particularly advantageous embodiment of the invention. This embodiment differs from the previous embodiments by the fact that the cutting device 14 according to the invention ensures the joining of two sandwich structures 50, 52 prior to the utilization thereof.

Thus, in the embodiment of FIG. 5, the two parts 10 to be cut form the skins of a first sandwich structure 50, whose core is constituted by a cellular material 48, e.g. a honeycomb material. The pyrotechnic expansion tube 16 is housed in a space 28, which is free from cellular material and located in the vicinity of one of the edges of the sandwich structure 50. A spacer 36 defines the space 28 on the side of the cellular material 48. Said spacer 36 is fixed between the parts 10 by fixing means such as the not shown bolts, whose location 38 is as far away as possible from the pyrotechnic expansion tube 16. Beyond the space 28 and tube 16, terminal portions of the two parts 10 penetrate the second sandwich structure 52.

More specifically, the second sandwich structure 52 comprises two skins 40, a cellular material, e.g. honeycomb material core 56 and a spacer 20 replacing the core 56 along the edge of said structure adjoining the first sandwich structure 50.

The terminal portions of the two parts 10 penetrate between the skins 40 and spacer 20 and fixing means such as not shown bolts link the stack formed in this way by the skins 40, parts 10 and spacer 20. These fixing means are located at a location 30 as close as possible to the edges 42 of skins 40 and face 21 of the spacer 20 turned towards the space 28. Moreover, the edges 42 and face 21 are aligned along the cutting lines 12 provided in the parts 10.

In the embodiment of FIG. 5, the skins 40 of the second sandwich structure 52 fulfill the same function as the abutments in the previously described embodiments. This is why they are designated by the same reference numerals.

It should be noted that in the embodiment described relative to FIG. 5, it is possible to integrate the pyrotechnic expansion tube 16 into the structure, during the manufacture of the latter.

In general terms, the pyrotechnic cutting device 14 in all cases permits a direct cutting of one or two nonmetallic material parts and in particular composite material parts, along one or more clearly defined and well localized cutting lines, under generally satisfactory cleanness conditions.

It should be noted that the simultaneous cutting of two parts is preferable whenever possible, as a result of the perfect symmetry then obtained in the device. Thus, the energy required for ensuring cutting is then at a minimum level.

In all cases, the cutting of nonmetallic material parts is ensured, whilst maintaining the mechanical strength thereof prior to cutting due to the absence of machining. In addition, the direct cutting of nonmetallic materials leads to a significant reduction in the energy required for cutting compared with the prior art procedure in which it was necessary to cut intermediate metal parts. Consequently, the shock produced by cutting is very significantly reduced, which is an important advantage relative to installations and equipment which may to be embarked in the vicinity of the device.

Finally, when the device comprises two pairs of parts (FIGS. 2 and 4), the cutting lines 12 can be aligned with the same spacer 20, as has been shown, or can be aligned with each of the spacers 20 and 36.

What is claimed is:

1. Pyrotechnic cutting device comprising a pyrotechnic expansion tube installed in a space formed between two parts and defined by at least one spacer linking said two parts, so as to cut at least one of the parts along at least one cutting line when the tube is used, wherein each part to be cut is made from a nonmetallic material, an abutment being fixed thereto, opposite to and facing the spacer, so that one edge of the abutment extends along the cutting line.

2. Device according to claim 1, wherein the abutment is substantially non-deformable.

3. Device according to claim 1, wherein the abutment is made from a deformable material.

4. Device according to claim 3, wherein a maintaining member, made from a deformable material, is fixed to each part to be cut, opposite to and facing the pyrotechnic expansion tube, the maintaining member comprising an edge extending along the cutting line and being prolonged on moving away from said edge.

5. Device according to claim 4, wherein the abutment and maintaining member are made from the same material as the part to be cut and said material is a composite material formed from sheets of long fibres embedded in a resin matrix.

6. Device according to claim 1, wherein said parts and the spacer are made from the same nonmetallic material in monolithic form.

7. Device according to claim 1, wherein the spacer is fixed between the parts by fixing means traversing the same.

8. Device according to claim 1, wherein only one of the two parts is to be cut, the other part being a substantially non-deformable support part.

9. Device according to claim 1, wherein both parts are to be cut, said space being defined by two spacers and an abutment being placed on each of said parts facing a first of the spacers.

10. Device according to claim 9, wherein the two parts form skins of a first sandwich structure and the two abutments form skins of a second sandwich structure penetrated by the terminal portions of said parts.

11. Device according to claim 9, wherein the second spacer is fixed between the parts at a location remote from the pyrotechnic expansion tube.

* * * * *